US005630371A

United States Patent [19]

Morrelli et al.

[11] Patent Number: 5,630,371

[45] Date of Patent: May 20, 1997

[54] CATAMARAN

[75] Inventors: Gino J. Morrelli, Tustin; James H. Melvin, Westminster; John A. Wake, Dana Point; Kevin M. Thompson, Temecula; Matt S. Miller, Del Mar, all of Calif.

[73] Assignee: R.R. Sail, Oceanside, Calif.

[21] Appl. No.: 540,574

[22] Filed: Oct. 6, 1995

[51] Int. Cl.[6] ..... B63B 1/00

[52] U.S. Cl. ..... 114/61; 114/39.1

[58] Field of Search ..... 114/61, 39.1, 354

[56] References Cited

U.S. PATENT DOCUMENTS

| | | | |
|---|---|---|---|
| 4,406,239 | 9/1983 | Enzmann | 114/39.1 |
| 4,569,301 | 2/1986 | Pyburn | 114/61 |
| 4,998,498 | 3/1991 | Gallichan | 114/61 |
| 5,355,829 | 10/1994 | Waddell et al. | 114/361 |

*Primary Examiner*—Jesus D. Sotelo
*Attorney, Agent, or Firm*—Joseph E. Mueth

[57] ABSTRACT

A catamaran having two spaced apart elongated hulls joined by front and rear cross members holding the hulls in alignment, and having a trampoline extending between the cross members. Cables or wires are carried within enclosures forming side loops in the trampoline and running from the front to the rear of the trampoline between cross members. A plurality of restraining hooks are affixed to the sides of each of the hulls. The cables are detachably held by the hooks to maintain lateral tension in the trampoline.

A rudder blade assembly at the rear end of each hull includes a tiller arm connected at its upper end to a tiller crossbar, the connection between the upper ends of the tillers and the ends of the crossbar being live flexible rubber elbows with a snap connect and disconnect between tiller crossbar and the upper ends of the tillers.

Pre-formed cylinders are laterally molded into the sides of each of the hulls and positioned to snugly receive the front and rear cross members.

A plurality of seating pads are disposed on the deck of each of the hulls, the seating pads being positioned and spaced to assure optimal passenger weight distribution.

5 Claims, 4 Drawing Sheets

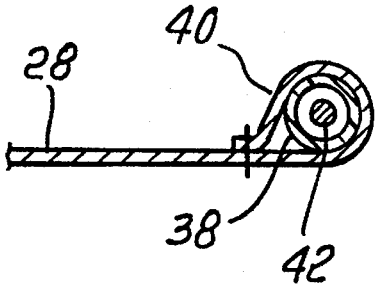
FIG. 4.
FIG. 5.
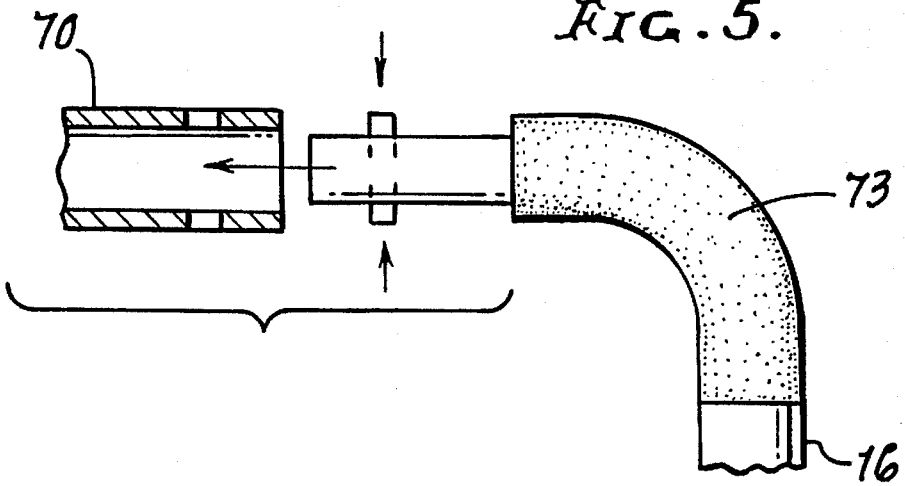
FIG. 6.
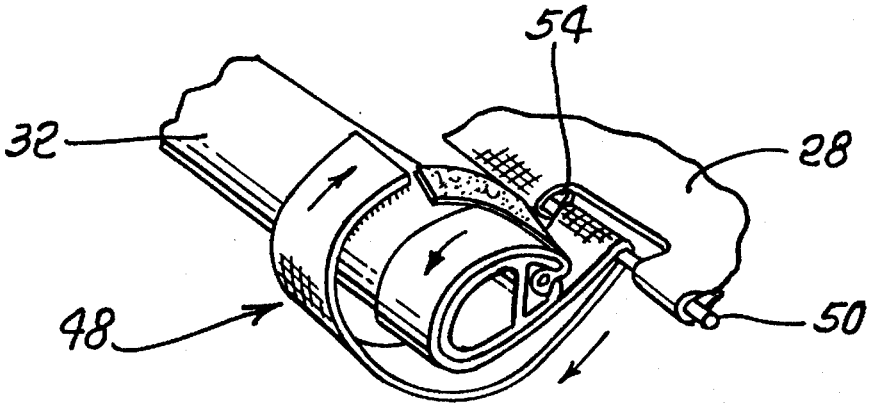

CATAMARAN

BACKGROUND OF INVENTION

Catamarans represent a popular type of small sailing craft. They are not intended to be left in the water when not in use. Normally, they are pulled from the water for storage. The storage of catamarans is something of a problem. In the existing catamarans, the mast and sail are easily removed. However, the two hulls, front and rear cross-members and the trampoline are not easily or quickly disassembled for storage. In the assembled condition, a catamaran even without its mast occupies considerable space. The difficulty in disassembly of the hulls, cross-members and trampoline is due to several construction features found in most commercially available catamarans. The primary difficulty is due to the manner of attachment of the trampoline to the hulls and one or both cross-members which typically involves a series of ropes or cables which are interlaced between islets in the edges of the trampoline. This arrangement is quite time consuming to take apart and re-assemble.

In another aspect, prior catamarans have a horizontal cross bar running between the two tiller arms with mechanical or hinged connections. This construction is not readily adapted to being taken apart and re-assembled.

Examples of some approaches to making catamarans more easily assembled can be found in Krolczyk U.S. Pat. No. 5,042,411, Edder U.S. Pat. No. 4,813,366, Chang U.S. Pat. No. 4,796,555, Gallichah U.S. Pat. No. 4,998,498, Robertson U.S. Pat. No. 4,823,717, Guergen U.S. Pat. No. 4,817,548, Stover U.S. Pat. No. 4,228,756 and McMillen WO88/08804.

The present invention presents a novel catamaran construction which is easy to break down into its components for compact storage which also being simple and quick to set up and make ready for sailing.

SUMMARY OF INVENTION

Briefly, the invention comprises a catamaran having two spaced apart elongated hulls joined by front and rear cross members holding the hulls in alignment, and having a trampoline extending between the cross members, the improvement comprising cables or wires carried within enclosures forming side loops in the trampoline and running from the front to the rear of the trampoline between cross members, a plurality of restraining hooks affixed to the sides of each of the hulls, the cables being detachably held by the hooks to maintain lateral tension in the trampoline.

The leading edge of the trampoline is slidably received and held in the front cross member and the trampoline is held by a plurality of Velcro straps to the rear cross member.

Preferably, the cables or wires are enclosed within Teflon tubes positioned within the side loops of the trampoline to facilitate assembly and disassembly, and reduce wear and tear on the trampoline.

In another aspect, the improvement comprises a rudder blade assembly at the rear end of each hull which includes a rudder or tiller arm connected at its upper end to a tiller crossbar, the connection between the upper ends of the tiller arms and the ends of the crossbar being live flexible rubber elbows with a snap connect and disconnect between tiller crossbar and the upper ends of the tiller arms for ready assembly and disassembly.

In yet another aspect, the improvement comprises preformed cylinders which are laterally molded into the sides of each of the hulls and positioned to snugly receive the front and rear cross members.

In still another aspect, a plurality of seating pads are disposed on the deck of each of the hulls, the seating pads being positioned and spaced to assure optimal passenger weight distribution.

THE DRAWINGS

Turning to the drawings:

FIG. 4 is a sectional view taken along the line 4—4 in FIG. 3;

FIG. 5 is an enlarged view, in partial section, of the "live" flexible rubber elbow and quick release connecting the upper end of each of the rudder arms or tillers to the tiller crossbar; and FIG. 6 is an enlarged view showing the Velcro attachment of the trampoline to the rear cross member.

DESCRIPTION OF PREFERRED EMBODIMENTS

Figure 1:
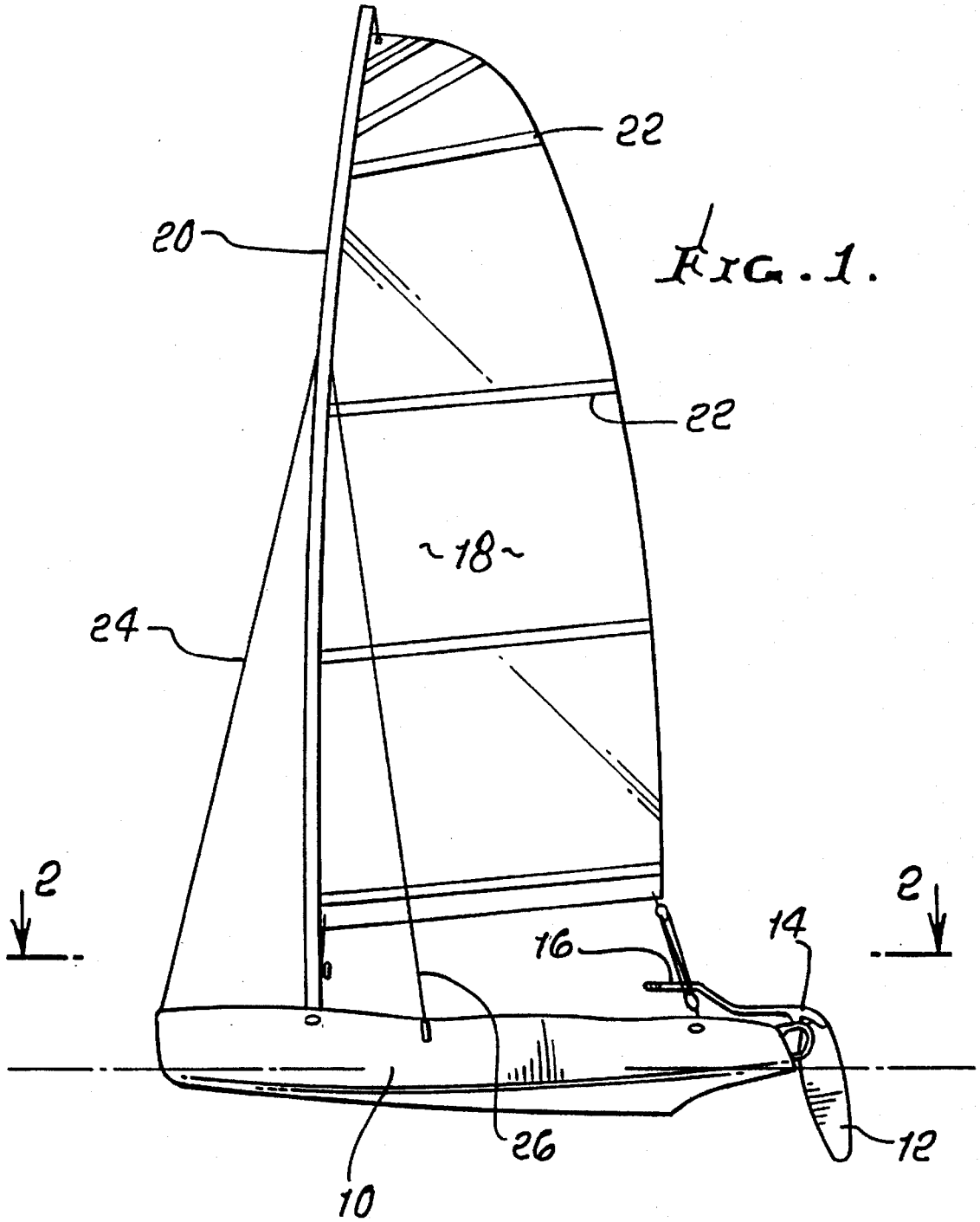
FIG. 1 is a side view of the novel catamaran of this invention.
Figure 2:
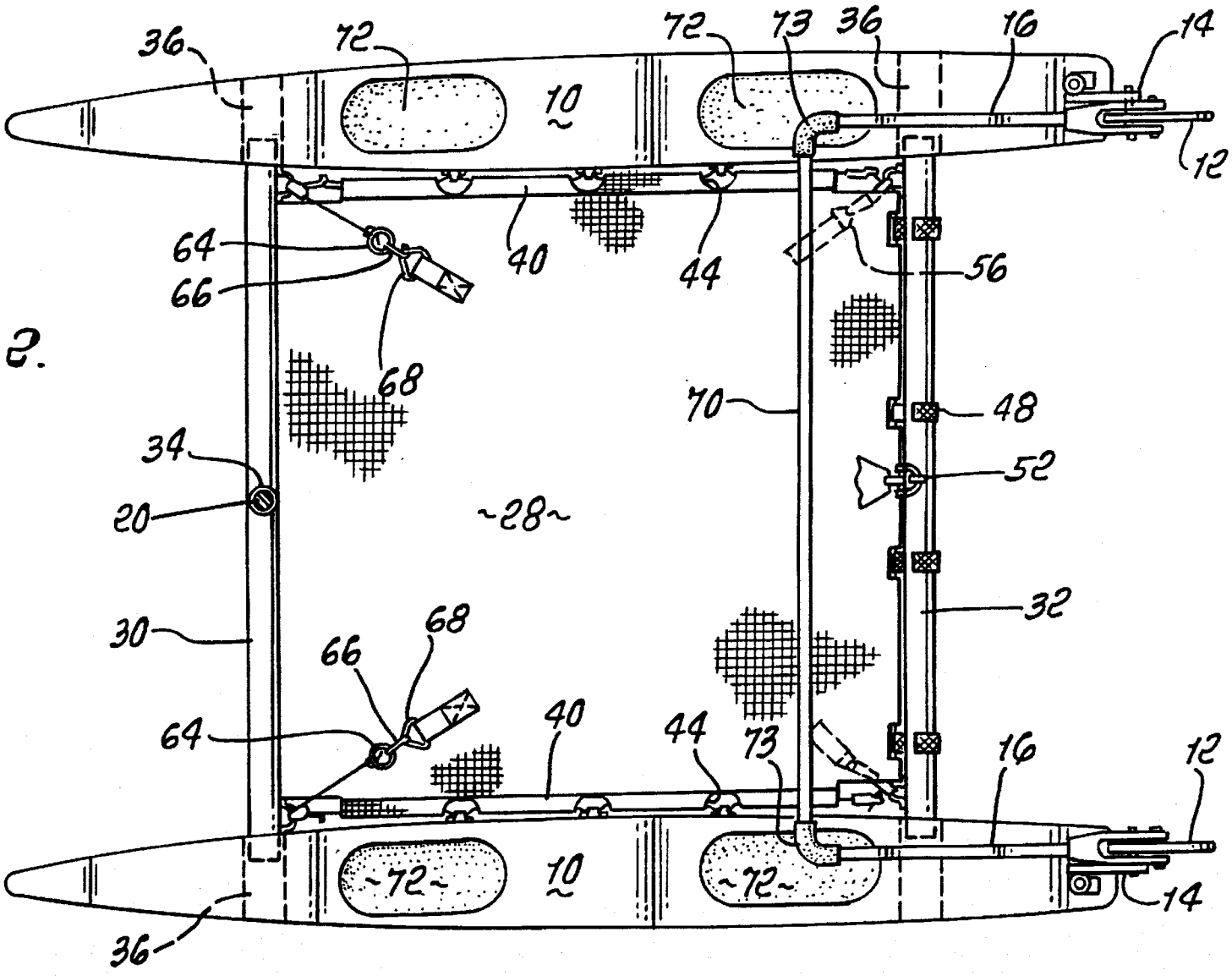
FIG. 2 is a top plan view taken along the line 2—2 in FIG. 1.
Figure 3:
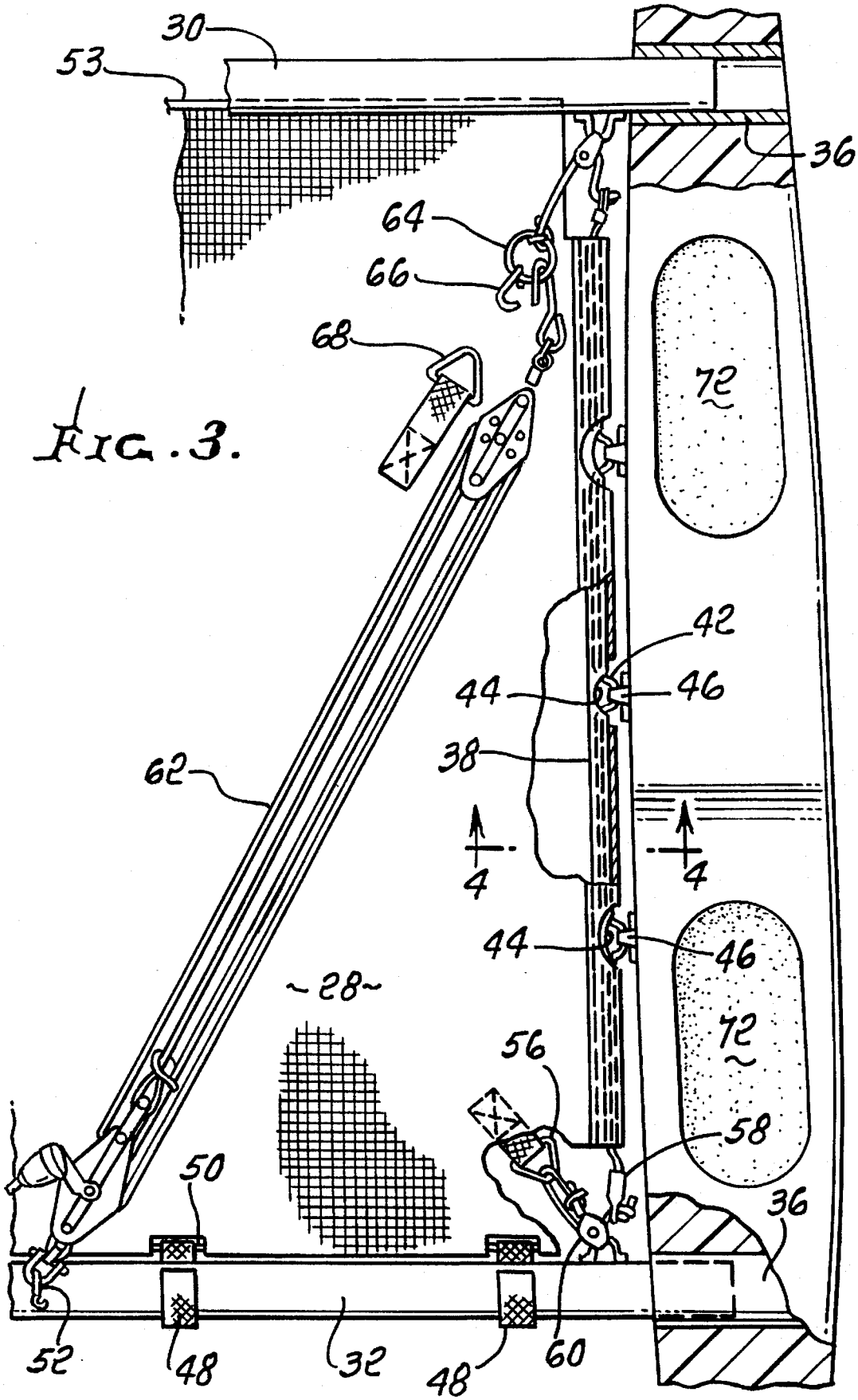
FIG. 3 is an enlarged top view, in partial breakaway, showing one of the two hulls, the detail of the connection of the front and rear cross members to the hull, and the connection of the trampoline to the hull and to the front and rear cross members.

Turning to the drawings in more detail, the catamaran has two aligned elongate hulls 10, each provided at its rear end with a rudder 12 carried by a rudder casting 14 and from which extends upwardly a tiller or rudder arm 16.

The sail 18, mast 20, battens 22, forestay 24, and shrouds 26 at each side are of the usual construction and need no further description.

Extending between hulls 10 is trampoline 28, front cross member 30, and rear cross member 32. The cross members are sometimes also referred to as crossbars. The front cross member 30 at its upper center carries mast step casting 34 which connects and rotatably holds the mast 20 to the front cross member 30.

The undersides of both front cross member 30 and rear cross member 32 are provided with stops (not shown) to limit the advancement of the ends of the cross members into the pre-formed cylinders 36 which are laterally molded into the sides of each of the hulls 10. The cross members are snugly received in the cylinders 36. When the cross members 30 and 32 are fully advanced against the stops, the hulls are in alignment.

The trampoline 28 has Teflon side tubes 38 received in folded over portions 40 forming side loops in the trampoline. The tubes 38 can be a series of tubes inserted in each folded over portion 40 in end-to-end fashion or one continuous tube can be used per side with the tube having cutouts at appropriate intervals. Within the Teflon tubes are braided wires or cables 42 running from the front to rear cross members. The braided cables or wires 42 are accessible through openings or cutouts 44 in the folded over portions 40. The spacing between Teflon tubes 38 permits access to cables or wires 42. The wires 42 are received under each of a plurality of 270 degree hooks 46 affixed to the hulls 10 at spaced intervals corresponding to the spacing of cutouts 44. The rear crossbar 32 has Velcro straps 48 for tensioning the trampoline which are wrapped around rod 50 laced through the trampoline. The rear cross bar 32 also has a small stainless steel loop fitting 52 on the top and center.

It is necessary to feed the trampoline into the front cross bar 30. There is a rope 53 molded into the front edge seam of the trampoline. There is a lateral slot running the length of the front cross member 30. The rope keeps the trampoline from slipping out of the front cross member 30. This is of standard construction.

To assemble the catamaran it is necessary to feed the trampoline lace rod 50 into the pocket 54 at the rear of the trampoline. The rear cross bar 32 is then placed along the rear edge of the trampoline. The velcro straps 48 are passed through the openings in the trampoline and around the lace rod 50 passing from top to bottom. The velcro straps are strapped back to their anchors loosely. The cross bar 32 is rolled towards the trampoline one complete revolution. This winds the straps 48 once around the cross bar 32. Once the trampoline is assembled to the front and rear cross bars, the velcro straps at the rear should be checked so that they are loose. The left end of the front crossbar 30 is partially inserted into the left hulls. Similarly, the rear cross bar 32 is inserted into the left hull, keeping the straps 48 rolled around the rear cross bar. The cross bars 30 and 32 have stops built into the underside that limit the depth the cross bar can be inserted. The front cross bar is partially inserted into the right hull. The rear cross bar is also partially inserted into the right hull. Working front and rear, by wiggling the hull, the cross bars are fully inserted in both hulls. The two trampoline cables 42 are passed from the front cross bar 30 through the Teflon tubes 38 in the trampoline side loops 40 to the rear cross bar 32.

Rear "D" rings 56 are sewn to the underside of the trampoline. The end of cable 42 has a cable eye 58. The pulley block 60 is tied and knotted to the cable eye 58 and the "D" ring 56 at each side.

As shown, the trampoline side cables hook onto the three spaced apart 270 degree hooks 46 on the inner side of each hull. To tension the trampoline, a mainsheet 62 is preferably used. The mainsheet is hooked to the ring 64 fastened to the trampoline cable system at front of trampoline. It is possible to start on either left or right side. The procedure is as follows:

(1) Pull tension on the mainsheet 62 until the cable system ring 64 and hook 66 and "D" ring 68 are in proximity.

(2) Connect hook 66 to "D" ring 68, attached to the trampoline.

(3) Release the mainsheet 62 tension and unhook from ring 64.

(4) Repeat the process on the opposite side.

(5) The mainsheet is then removed.

The pre-formed cylinders 36 are molded into the hulls 10 and snugly receive the cross members 30 and 32. In this arrangement, the elements forming the ends of the cross members to the hulls do not protrude onto the decks of the hulls or interfere with the operation of the catamaran.

The two seating pads 72 positioned at spaced intervals on the deck of each of the hulls 10 are disposed so that the passenger weight is distributed to provide optimal performance of the catamaran.

Another important feature of this invention relates to the connection of the tiller arms 16 to the tiller bar 70. The arms 16 and tiller bar 70 are connected by live flexible urethane rubber elbows 72. As shown in FIG. 5, quick connect and disconnect is provided by push button. The elements are present at both ends of the tiller bar. The urethane elbow is flexible and resilient, and completely dispenses with the need for mechanical interconnections.

As can be seen, it is rather simple to break down the assembled trampoline by manually first removing the sail and mast, then releasing the hooks 46 from the cables 42, undoing the Velcro straps 48, separating the hulls from the cross members 30 and 32, and rolling up the trampoline with the cross members.

Having fully described the invention, it is intended that it be limited only by the lawful scope of the appended claims.

We claim:

1. A catamaran having two spaced apart elongated hulls joined by front and rear cross members holding said hulls in alignment, and having a trampoline extending between said cross members, the improvement comprising cables carried within enclosures forming side loops in the trampoline and running from the front to the rear cross members, a plurality of restraining hooks affixed to the sides of each of the hulls, the cables being detachably held by said hooks to maintain lateral tension in the trampoline, and the leading edge of the trampoline being slidably received and held in the front cross member.

2. A catamaran having two spaced apart elongated hulls joined by front and rear cross members holding said hulls in alignment, and having a trampoline extending between said cross members, the improvement comprising cables carried within enclosures forming side loops in the trampoline and running from the front to the rear cross members, a plurality of restraining hooks affixed to the sides of each of the hulls, the cables being detachably held by said hooks to maintain lateral tension in the trampoline, wherein said cables are enclosed within Teflon tubes carried within said side loops of the trampoline to facilitate assembly and disassembly, and to minimize wear on the trampoline.

3. The catamaran of claims 1 or 2, the improvement which further comprises a rudder blade assembly at the rear end of each hull which includes a tiller connected at its upper end to a tiller crossbar, the connection between said upper ends of the tillers and the ends of the crossbar being live flexible rubber elbows with a snap connect and disconnect between tiller crossbar and the upper ends of the tillers.

4. A catamaran of claims 1 or 2, the improvement which further comprises pre-formed cylinders laterally molded into the sides of each of the hulls and being positioned to snugly receive the front and rear cross members.

5. A catamaran of claims 1 or 2, the improvement which further comprises a plurality of seating pads disposed on the deck of each of the hulls, the seating pads being positioned and spaced to assure passenger weight distribution.

* * * * *